US006004635A

United States Patent [19]

Li

[11] Patent Number: 6,004,635

[45] Date of Patent: Dec. 21, 1999

[54] ARTIFICIAL PLANT ASSEMBLY

[76] Inventor: Wing Hon Li, Flat A-D, 5/Fl., City Industrial Complex, 116-122 Kwok Shui Rd., Kwai Chung, N.T., The Hong Kong Special Administrative Region of the People's Republic of China

[21] Appl. No.: 09/062,562

[22] Filed: Apr. 20, 1998

[51] Int. Cl.[6] ..... A41G 1/00

[52] U.S. Cl. ..... 428/23; 428/27; 47/41.12; 248/27.8

[58] Field of Search ..... 428/23, 24, 27; 248/27.8; 47/41.12

*Primary Examiner*—Alexander Thomas
*Attorney, Agent, or Firm*—Albert O. Cota

[57] ABSTRACT

An artificial plant assembly (10) that includes a base (12) which serves as a platform for securing the assembly (10) when it is inserted into a vase or the like. The base (10) which can be made in a variety of geometrical shapes such as a circle, a square or a multi-sided shape includes a central stem bore (18) and a plurality of outer stem bores (20). Into the bore (18) is inserted a central stem support (30) which has an upper edge (38) which includes a plurality of inner stem bores (42). Around the central stem support (30) is located, in a random or symmetrical pattern, a plurality of outer stem bores (20). Into the bores (20 and (42) is inserted an inner core (62) into which is inserted one or a plurality of nested and rotatable bulbous sections (70, 92, 102). Each bulbous section has an upper end which terminates with a flora (84) which may consist of a flower of leaf or a combination of various flora.

20 Claims, 3 Drawing Sheets

ARTIFICIAL PLANT ASSEMBLY

TECHNICAL FIELD

The invention pertains to the general field of artificial plants and flowers and more particularly to an artificial plant assembly that includes a stationary base which includes an attached central stem support which supports a plurality of rotatable flora stems and a plurality of surrounding bores which also support rotatable flora stems.

BACKGROUND ART

For as long as people have been living and working within enclosed spaces, such as houses and buildings, the inclusion of plant life into the decor has been of substantial importance. Whenever plant life is added to an interior decor, a feeling of natural beauty and life, which is usually only found in an outdoor environment, is achieved. The addition of plant life into an enclosed space is also a significant means of improving both the mental well-being and physical health of those individuals who must remain within the enclosed space for extended durations of time. The plant life provides an excellent diversion from normal interior furnishings and can accentuate almost any design scheme.

Although the benefits of interior plant life are obvious, there are deterrents. The most pronounced deterrents are that many types of live plants must have consistent direct or partial sunlight and a constant supply of water. A live plant may be placed in a location where it receives an optimal amount of sunlight, but often this is not sufficient and the plant will eventually die. Also, the locations of optimal sunlight are frequently not the most preferred locations for a decorative scheme.

In response to these problems many different types and species of artificial plants have been created. These artificial plants have evolved to the point where it is now very difficult to tell whether a plant is alive or merely a good artificial reproduction. When artificial plants were first introduced many people were reluctant to use them because of the poor quality and obvious fake appearance of the plants. This problem has been overcome and most artificial plant today are extremely realistic.

One type of widely used artificial plant includes a central stem having attached thereto a plurality of fronds with outward extending leaves. Due to the methods by which this type of artificial plant, as well as many others are currently designed and assembled, there is one aspect that causes the plant to appear artificial. This is the result of how the section of the plant where the branches are joined to the central stem. It is difficult to attach the fronds in a manner that is both structurally sufficient for support and to provide a realistic appearance. For this attachment either the branches are attached in a realistic manner, which can cause them to fall or lean in unnatural positions, or they are insecurely attached, thereby clearly exposing the attachment means and method.

It is therefore readily apparent that some structure/assembly and method of creating artificial plants which does not sacrifice the structural integrity of the plant or its realistic appearance is needed.

A search of the prior art did not disclose any patents that read directly on the claims of the instant invention, however the following U.S. patents are considered related:

| U.S. Pat. No. | INVENTOR | ISSUED |
|---|---|---|
| 4,215,163 | Lee | 24 July 1980 |
| 3,829,349 | Hermanson | 13 August 1974 |
| 1,153,418 | Shing (U.K.) | 29 May 1969 |
| 2,826,845 | Warren | 18 March 1958 |

The U.S. Pat. No. 4,215,163 Lee patent discloses an artificial flower assembly that is made from a plastic stem unitarily molded around a reinforcing wire with integral side petioles, an internal calyx and an internal coupling member. A subassembly of fabric petals, preferably silk which may be printed for viewing is made by loosely mounting the petals on a plastic tubular member which is then mounted on the internal coupling member.

The U.S. Pat. No. 3,829,349 Hermanson patent discloses a collapsible artificial tree arrangement. The arrangement is particularly adapted for a Christmas decoration in which simulated branches are freely foldable substantially parallel to the tree's trunk, or they may pivot to an erect position for display. The arrangement includes an elongated trunk core and a plurality of sectional trunk portions some of which have branch holding sockets while others serve as spacing members.

The U.S. Pat. No. 1,153,418 Shing (U.K.) patent discloses a structure for making an artificial flower or the like. The structure includes a one-piece connector which is typically cut from a pliable metal. The connector has a central section from where radiates a plurality of limbs into which are inserted and attached a like plurality of leaves, brackets, petals and other decorative elements. The connector also has a central aperture into which is inserted and attached a stem. Prior to attaching the stem, a plurality of leaves may be attached to the stem by means of a tubular boss.

The U.S. Pat. No. 2,826,845 Warren patent discloses an artificial Christmas tree that can be assembled from readily separate members. The invention is designed to closely simulate a natural Christmas tree while providing an artificial tree which may be assembled or disassembled by unskilled persons with a minimum of direction and time. When not in use the tree may be disassembled and subsequently packed and stored in a relatively small container.

For background purposes and as indicative of the art to which the invention relates, reference may be made to the following remaining patents found in the search.

| U.S. Pat. No. | INVENTOR | ISSUED |
|---|---|---|
| 5,395,664 | Thompson, Jr. | 7 March 1995 |
| 5,320,884 | Tai, et al | 14 June 1994 |
| 4,585,677 | Hwang, et al | 29 April 1986 |
| 4,386,480 | Horowitz | 7 June 1983 |
| 4,106,233 | Horowitz | 15 August 1978 |
| 3,639,196 | Hermanson | 1 February 1972 |
| 3,041,766 | Decamp | 17 November 1962 |
| 2,984,036 | Adler, Jr. | 16 May 1961 |
| 1,495,695 | Karr | 17 May 1924 |

DISCLOSURE OF THE INVENTION

The artificial plant assembly disclosed herein is designed to be quickly and easily assembled into a realistically appearing plant. In its most basic design configuration, the artificial plant assembly consists of a base, a central stem support which is inserted into a central stem bore, at least two rotatable fronds, and a means for attaching and maintaining the rotatable fronds onto the central stem support or onto the base.

The central stem support is comprised of a substantially rigid inner core and an outer stem molded of plastic around the inner core. The outer stem can include a multiplicity of flora, such as leaves and/or flowers that are integrally and outwardly attached. The outward attachment direction includes at least one leaf or flower extending from each stem's upper terminus. The flora are attached on the same plane and are staggered to increase the realism of the flora extending from the central stem support or the base.

The rotatable fronds are comprised of substantially rigid inner cores and outr stems that are molded around the inner cores. To each outer stem is also integrally molded a multiplicity of leaves and/or flowers that extend from each outer stem's upper terminus. The means for rotatably attaching and maintaining the rotatable fronds into the upper surface of the central stem support or the base utilizes an attachment means. Bulbous sections extend from the upper surface of the central stem support and a complimentary bulbous section that is located on the lower end of the outer stem of each rotatable frond. The bulbous section on each rotatable frond includes a side opening that allows it to be inserted over the lower end of one of the rotatable fronds or into a bore located on the base. Once one of the rotatable fronds is inserted, the attachment means holds the rotatable frond captive within one of the bores on the upper surface of the central stem support or within one of the bores located on the base.

As additional rotatable fronds are inserted into the central stem support or the base, the bulbous section of the first frond nests against the bulbous section on the second frond. The subsequent frond bulbous sections inserted onto the upper surface of the central stem support or the base, nest into the bulbous section located on the previously inserted rotatable frond.

To add further realism to the artificial plant assemblies a series of longitudinally spaced circular indentations are included on both the central stem support and each rotatable frond. Also, the flora which are preferably made of a resilient material such as silk can be coated with a fire retardant to prevent or reduce incidents of fire.

In addition to the primary object of the invention it is also an object of the invention to produce an artificial plant assembly that:

- can accurately reproduce the appearance of an actual living plant,
- can be made of various sizes,
- can be designed to include any number of rotatable fronds,
- can be intermeshed with a combination of leaf and flow fronds,
- is relatively maintenance free, and
- is cost effective from both manufacturing and consumers points of view.

These and other objects and advantages of the present invention will become apparent from the subsequent detailed description of the preferred embodiment and the appended claims taken in conjunction with the accompanying drawings.

BRIEF DESCRIPTION OF THE DRAWINGS

FIG. 5 also shows a lower section that includes a plurality of indentations.

BEST MODE FOR CARRYING OUT THE INVENTION

The best mode for carrying out the invention is presented in terms of a preferred embodiment for an artificial plant assembly. The invention is designed to provide a superior design, when compared to current competitive art, for artificial plants. The superior design allows artificial plants to be placed and positioned in more realistic attitudes, due to the unique method of attaching the stems and leaves to the plant's base. The greater realism adds considerable beauty to the artificial plant assembly and thereby increases the plants popularity and utility especially in situations where previously only living plants would suffice.

Figure 1:
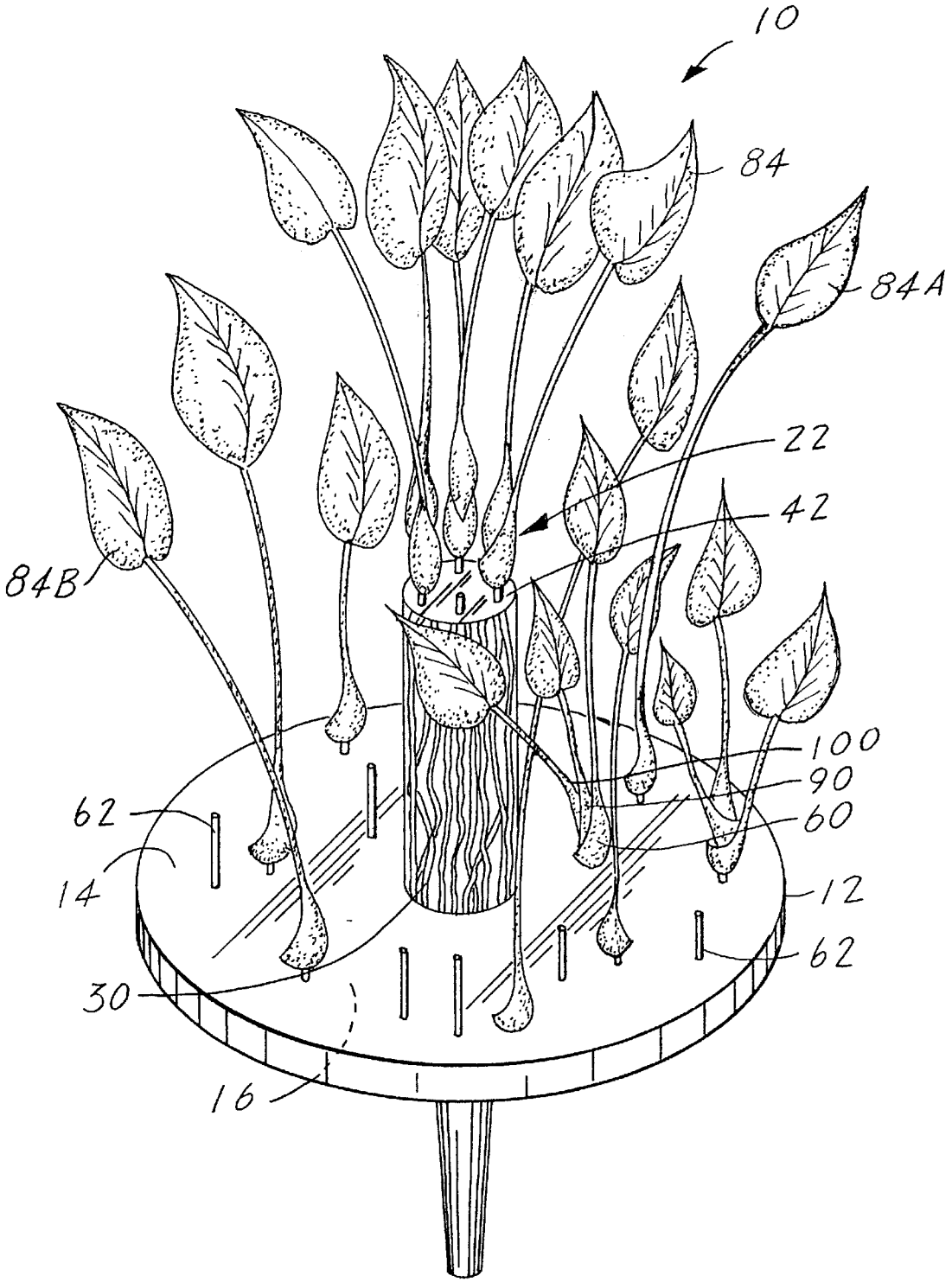
FIG. 1 is a perspective view of the artificial plant assembly.

The preferred embodiment of the artificial plant assembly 10, hereinafter "assembly 10", as shown in FIGS. 1–7, is comprised of the following major elements: a base 12, a central stem support 30, a first rotatable frond 60, a second rotatable frond 90, and a third rotatable frond 100. The completely assembled artificial plant assembly 10 is shown in FIG. 1.

Figure 2:
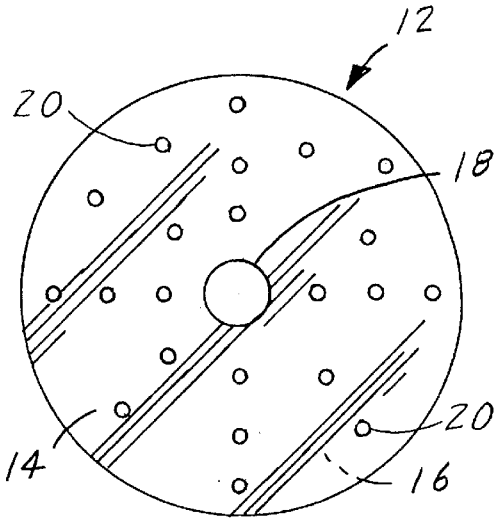
FIG. 2 is a upper plan view of the base.
Figure 3:
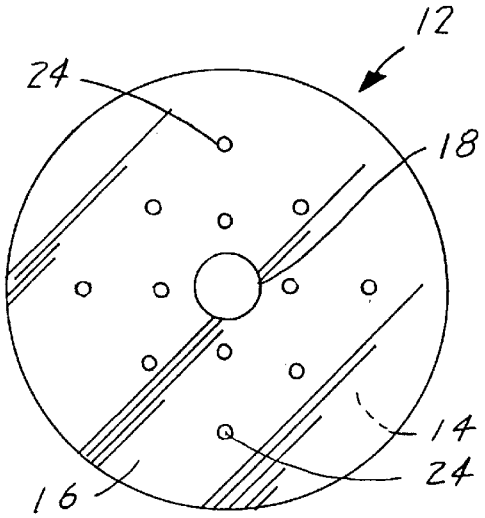
FIG. 3 is a bottom plan view of the base.

In order to provide stability for the assembly 10, the base 12, as shown in FIGS. 1, 2 and 3 is utilized. The base 12 has an upper surface 14, a lower surface 16, a central stem bore 18 and a plurality of outer stem bores 20 which surround the central stem bore18. For clarity the outer stem bores 20 are not shown in FIG. 3. The base 12 is further comprised of a plurality of protrusions 24, which are located on the lower surface 16 of the base 12 as shown in FIG. 3. The protrusions 24 function to provide additional stability when the assembly 10 is assembled and in place within a vase or the like.

Figure 4:
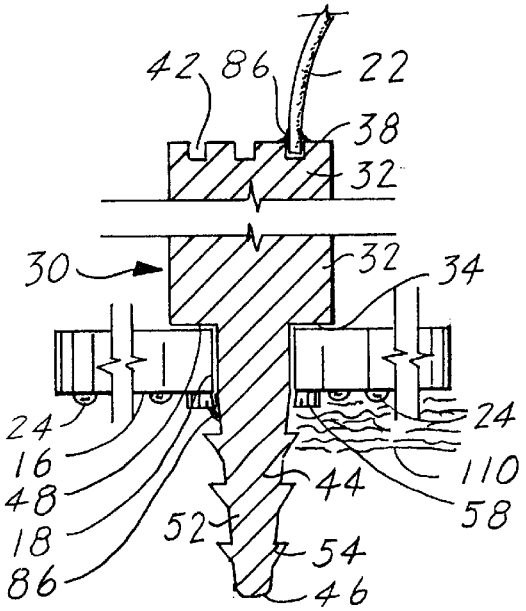
FIG. 4 is a partial sectional view showing an integral central stem support inserted into the base and with a lower section that includes a plurality of barbs.

As shown in FIGS. 1 and 4, the central stem support 30 is used to provide support for a plurality of central stems 22. The central stem support 30 is comprised of an upper section 32 having a first diameter, a lower edge 34 and an upper edge 38, wherein the upper edge 38 further has a plurality of inner stem bores 42 that support the central stems 22. A lower section 44, which is integral with the upper section 32 also has a lower edge 46, an upper edge 48 and a second diameter that is less than the first diameter. The second diameter is dimensioned to frictionally slide into and out of the lower surface 16 of the central stem bore 18.

Figure 5:
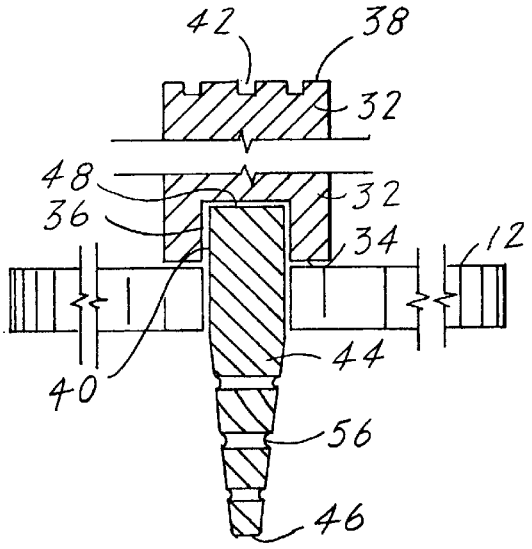
FIG. 5 is a partial sectional view showing a central stem support that is comprised of an upper section having a cavity that accepts the lower section.

In a second embodiment of the central stem support 30, as shown in FIG. 5, the lower edge 34 of the upper section 32 of the central stem support 30 has a substantially centered cavity 36, that is dimensioned to receive and attach, by an attachment means 40 the upper edge 48 of the lower section 44.

The lower section 44, of both embodiments preferably includes a tapered section 52. As shown in FIG. 4, the section 52 may include a plurality of upward facing arrow barbs 54 as shown in FIG. 4, or a plurality of indentations 56 as shown in FIG. 5. The barbs and indentations help to stabilize the central stem support when it is embedded in a assembly support material 110.

The assembly 10, can be further comprised of a sleeve 58, as shown in FIG. 4, that fits over the lower section 44 of the central stem support 30 and against the lower surface 16 of the base 12. The sleeve 58 functions further secure the central stem support 30 to the base 12. The sleeve 58 as well as the terminations of the central stems 22 and the stems 80 can include a quantity of an adhesive 86 that is placed at their interface as shown in FIG. 4.

To provide realistic appearing foliage, the rotatable first frond 10, second frond 90 and third frond 100, which may be multi-colored for added realism, are utilized.

Figure 6:
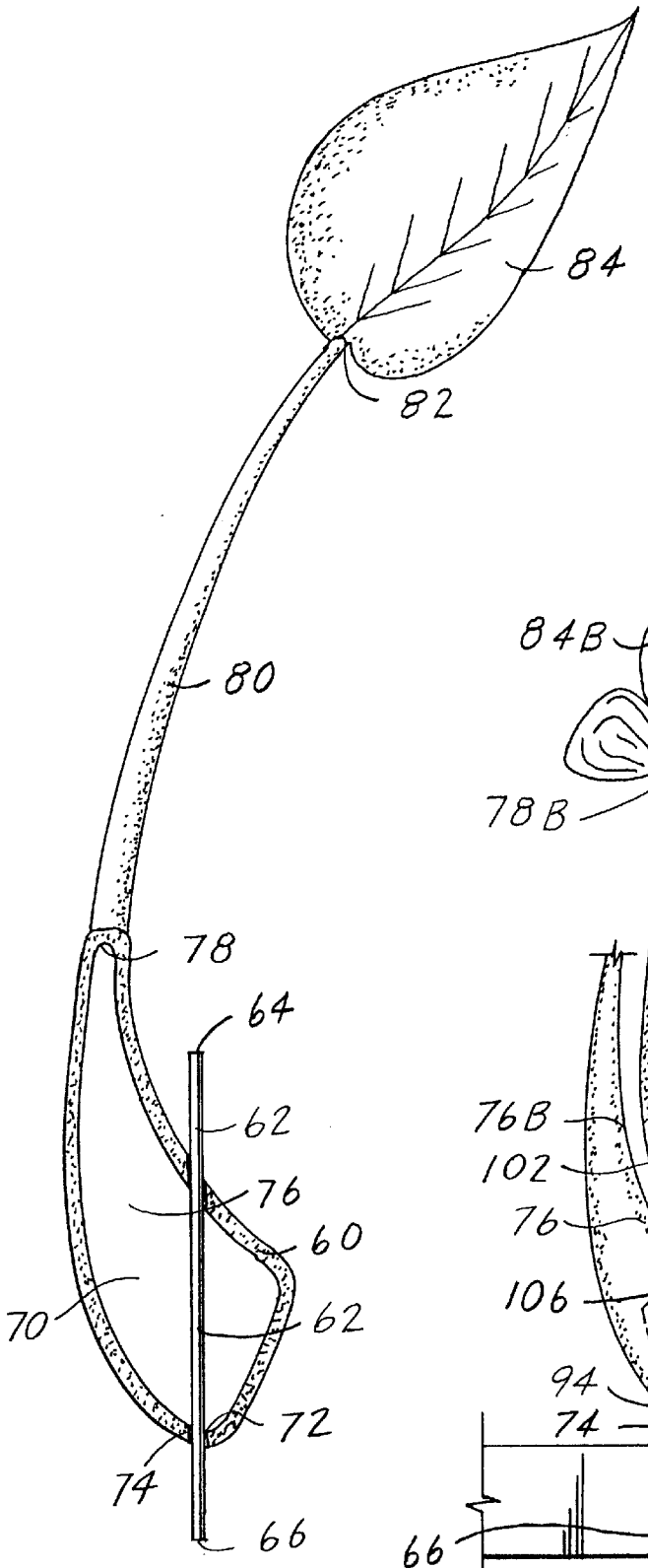
FIG. 6 is a partial sectional view of a typical bulbous section attached to an inner core and that includes at its upper terminus a stem having an upper end to which is attached a flora.
Figure 7:
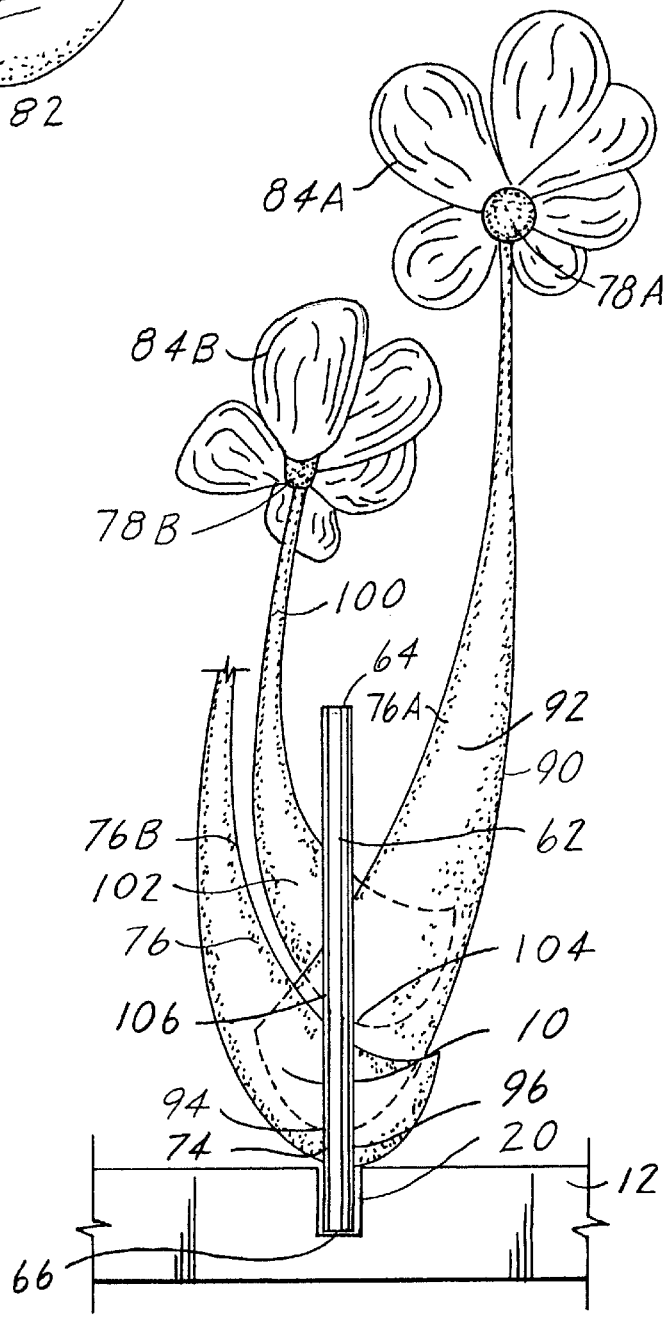
FIG. 7 is a partial sectional view showing three bulbous sections inserted into a single inner core.

The first rotatable frond 60, as shown in FIGS. 1, 6 and 7, comprises a substantially rigid inner core 62 having an upper end 64 and a lower end 66. The inner core 62 has a diameter that is dimensioned to allow the lower end 66 to frictionally fit into one of the outer stem bores 20 on the base 12 or into one of the inner stem bores 42 on the upper edge 38 of the upper section 32 on the central stem support 30. The first rotatable frond 60 also comprises a first hollow bulbous section 70, as best shown in FIG. 6. The first hollow bulbous section 70 includes a lower end 72, which has a substantially centered first core bore 74, and a side opening 76 which has an upper terminus 78 from where extends a stem 80 having an upper end 82 which terminates with a flora 84, wherein the first core bore 74 is rotatably inserted over the rigid inner core 62. The flora 84, 84A and 84B, as shown in FIGS. 1, 6 and 7, can be comprised of a variety of leaves and/or flowers.

There is at least one second rotatable frond 90, as shown in FIG. 7, which comprises a second hollow bulbous section 92 with a lower end 94 having a substantially centered second core bore 96. The second frond 90 also has a side opening 76A, which has an upper terminus 78A from where extends above the upper end 82 of the first rotatable frond 60 and which terminates with a flora 84A. The second bulbous section 92 is dimensioned to nest inside the side opening 76 of the first bulbous section 70 with the second core bore 96 also inserted over the rigid inner core 62, as shown in FIG. 7. The base 12, with the lower section 44 of the central stem support 30 protruding through the central stem bore 18, is designed to be placed into a vase that is partly filled with an assembly support material 110, which interfaces with the lower surface 16 of the base 12 and with the lower section 44 of the central stem support 30, which is embedded into the assembly support material 110.

The third rotatable frond 100, as also shown in FIG. 7, is comprised of a third bulbous section 102 with a lower end 104 having a substantially centered third core bore 106. The third frond 100 also has a side opening 76B further having an upper terminus 78B from where extends a flora 84B. The third bulbous section 102 is dimensioned to nest inside the side opening 76A of the second bulbous section 92 with the third core bore 106 also inserted over the rigid inner core 62.

When all three bulbous sections 70,92,102 are attached and/or inserted, the three sections form a cluster of rotatable fronds.

While the invention has been described in complete detail and pictorially shown in the accompanying drawings it is not to be limited to such details, since many changes and modifications may be made in the invention without departing from the spirit and scope thereof. Hence, it is described to cover any and all modifications and forms which may come within the language and scope of the appended claims.

I claim:

1. An artificial plant assembly comprising:

a) a base having an upper surface, a lower surface, a central stem bore and a plurality of outer stem insertion means which surround the central stem bore, b) a central stem support having an upper section that protrudes above the upper surface of said base and a lower section dimensioned to fit into the central stem bore and protrude below the lower surface of said base, wherein the upper section has an upper surface having a plurality of inner stem bores, and c) a rotatable frond comprising:

(1) a substantially rigid inner core inserted into at least one of said outer stem insertion means and into at least one of the inner stem bores on said central stem support, and (2) a hollow bulbous section which includes a lower end having a core bore therethrough, a side opening having an upper terminus from where extends a stem having an upper end which terminates with a flora, wherein the bore on said bulbous section is rotatably inserted into one of said rigid inner cores, wherein said base is designed to be placed into a vase partly filled with an assembly support material that interfaces with the lower surface of said base with the lower section of said central stem support embedded into the assembly support material.

2. The assembly as specified in claim 1 wherein said outer stem insertion means comprises a plurality of outer stem bores that are located on said base and which surround said center stem bore.

3. The assembly as specified in claim 2 further comprising a small quantity of an adhesive that is applied to the area where said inner core protrudes through the outer stem bore.

4. The assembly as specified in claim 1 wherein said outer stem insertion means comprises a plurality of outer stem cavities that are located on said base and which surround said center stem bore.

5. The assembly as specified in claim 1 wherein the lower section of said central stem support which protrudes from the lower surface of said base, tapers inward.

6. The assembly as specified in claim 5 wherein the tapered section of said lower section includes a plurality of upward facing arrow barbs.

7. The assembly as specified in claim 1 further comprising a sleeve that fits over the lower section of said central stem support and is juxtaposed against the lower surface of said base.

8. The assembly as specified in claim 1 wherein said flora is comprised of a variety of leaves or flowers.

9. The assembly as specified in claim 1 wherein said rotatable frond is further comprised of at least a second rotatable frond comprising a second bulbous section with a lower end having a substantially centered second core base, a side opening further having an upper terminus from where extends a stem having an upper end that extends above the upper end of said rotatable frond end which terminates with a flora, wherein said second bulbous section is dimensioned to nest inside the side opening of the bulbous section with the second core bore also inserted over the rigid inner core, wherein the two bulbous sections form a cluster of rotatable fronds.

10. The assembly as specified in claim 1 wherein said assembly support material is comprised of a fibrous material that is colored to simulate planting soil.

11. An artificial plant assembly comprising:

a) a base having an upper surface, a lower surface, a central stem bore, and a plurality of outer stem bores which surround the central stem bore, b) a central stem support comprising:

(1) an upper section having a first diameter, a lower edge and an upper edge, wherein the upper edge further having a plurality of inner stem bores, (2) a lower section having a lower edge, an upper edge and a diameter that is less than the first diameter, and dimensioned to frictionally slide into and out of the lower surface of the central stem bore, (c) a first rotatable frond comprising:

(1) a substantially rigid inner core having an upper end and a lower end wherein said inner core has a diameter that is dimensioned to allow the lower end to frictionally fit into one of the outer stem bores on said base or into one of the inner stem bores on the upper edge of the upper section of said central stem support, (2) a first hollow bulbous section which includes a lower end having a substantially centered first core bore, a side opening further having an upper terminus from where extends a stem having an upper end which terminates with a flora, wherein the core bore is rotatably inserted over the rigid inner core, and d) at least one second rotatable frond comprising a second hollow bulbous section with a lower end having a substantially centered second core bore, a side opening further having an upper terminus from where extends a stem having an upper end that extends above the upper end of said first rotatable frond and which terminates with a flora, wherein the second bulbous section is dimensioned to nest inside the side opening of the first bulbous section with the second core bore also inserted over the rigid inner core, wherein said base with the lower section of said central stem support protruding through the central stem bore is designed to be placed into a vase that is partly filled with an assembly support material that interfaces with the lower surface of said base and with the lower section of said central stem support, which is embedded into the assembly support material.

12. The assembly as specified in claim 11 wherein the lower section of said central stem support is integral with the upper section.

13. The assembly as specified in claim 11 wherein the lower edge of the upper section of said central stem support having a substantially centered cavity that is dimensioned to receive and attach, by an attachment means, the upper edge of said lower section.

14. The assembly as specified in claim 11 wherein the lower section of said central stem support, which protrudes from the lower surface of said base, tapers inward.

15. The assembly as specified in claim 14 wherein the tapered section includes a plurality of upward facing arrow barbs.

16. The assembly as specified in claim 14 wherein the tapered section include a plurality of indentations.

17. The assembly means as specified in claim 11 further comprising a sleeve that fits over the lower section of said central stem support and against the lower surface of said base.

18. The assembly as specified in claim 11 wherein said flora is comprised of a variety of leaves or flowers.

19. The assembly as specified in claim 11 wherein said rotatable frond is further comprised of a third rotatable frond comprising a third bulbous section with a lower end having a substantially centered third core bore, a side opening further having an upper terminus from where extends a stem having an upper end that extends above the upper end of said second rotatable frond and which terminates with a flora, wherein said third bulbous section is dimensioned to nest inside the side opening of the second bulbous section with the third core bore also inserted over the rigid inner core wherein the three bulbous sections form a cluster of rotatable fronds.

20. The assembly as specified in claim 11 whereins aid lower surface of said base is further comprised of a plurality of protrusions.

* * * * *